US008690290B2

(12) United States Patent
Masuda

(10) Patent No.: US 8,690,290 B2
(45) Date of Patent: Apr. 8, 2014

(54) LIQUID EJECTION DEVICE

(71) Applicant: Seiko Epson Corporation, Tokyo (JP)

(72) Inventor: Norihiro Masuda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/773,006

(22) Filed: Feb. 21, 2013

(65) Prior Publication Data

US 2013/0229458 A1 Sep. 5, 2013

(30) Foreign Application Priority Data

Mar. 5, 2012 (JP) ..... 2012-047695

(51) Int. Cl.
*B41J 2/165* (2006.01)

(52) U.S. Cl.
USPC ..... 347/30; 347/34; 347/90

(58) Field of Classification Search
USPC ..... 347/22, 29–37, 40, 45–47, 89–90
See application file for complete search history.

(56) References Cited

U.S. PATENT DOCUMENTS 6,491,369 B1 * 12/2002 Satoh et al. ..... 347/30
7,104,628 B2 * 9/2006 Yamazaki et al. ..... 347/29

FOREIGN PATENT DOCUMENTS

JP 2009-172937 A 8/2009

* cited by examiner

*Primary Examiner* — Thinh Nguyen
(74) *Attorney, Agent, or Firm* — Global IP Counselors, LLP

(57) ABSTRACT

A liquid ejection device includes: an ejection head configured and arranged to eject liquid from a nozzle; a suction container in which a first suction port, a second suction port that is farther away from the nozzle compared to the first suction port, and a discharge port are formed, air sucked from the first suction port and the second suction port passing through the suction container; and a suction device configured and arranged to suck the air from the discharge port to an outside of the suction container.

7 Claims, 4 Drawing Sheets

LIQUID EJECTION DEVICE

CROSS-REFERENCE TO RELATED APPLICATIONS

This application claims priority to Japanese Patent Application No. 2012-047695 filed on Mar. 5, 2012. The entire disclosure of Japanese Patent Application No. 2012-047695 is hereby incorporated herein by reference.

BACKGROUND

1. Technical Field

The present invention relates to a liquid ejection device that collects a mist of liquid generated by ejecting liquid from a nozzle.

2. Related Art

A technique for sucking a mist of ink generated by ejecting ink drops having light curing characteristics from a nozzle has been known (see Japanese Laid-Open Patent Publication No. 2009-172937). In Japanese Laid-Open Patent Publication No. 2009-172937, wind for sucking a mist of ink is applied to a heat releasing fin so as to cool an irradiation section that emits light for causing ink to cure. According to this publication, a suction fan for sucking a mist of ink and a suction fan for cooling the irradiation section can be made in common.

SUMMARY

In the above mentioned publication, however, the suction force of the suction fan needs to be controlled so as not to affect spray trajectories of ink drops ejected from the nozzle, which causes a problem that the cooling effect on the irradiation section is insufficient.

The present invention has been made to address the above-described circumstances, and an object of the present invention is to provide a technique for increasing the cooling effect on the irradiation section while controlling the influence on spray trajectories of ink drops.

A liquid ejection device according to one aspect includes an ejection head, a suction container and a suction device. The ejection head is configured and arranged to eject liquid from a nozzle. In the suction container, a first suction port, a second suction port that is farther away from the nozzle compared to the first suction port, and a discharge port are formed, air sucked from the first suction port and the second suction port passing through the suction container. The suction device is configured and arranged to suck the air from the discharge port to an outside of the suction container.

Further, the liquid ejection device according to an aspect of the present invention preferably has an adjustment section configured and arranged to adjust a suction amount of air in the second suction port.

In the liquid ejection device according to an aspect of the present invention, the adjustment section is preferably configured and arranged to adjust the suction amount of air sucked from the second suction port by changing an opening area of the second suction port.

In the liquid ejection device according to an aspect of the present invention, an air suction direction in the second suction port is preferably opposite to an air suction direction in the first suction port.

In the liquid ejection device according to an aspect of the present invention, when a spray distance of the liquid ejected from the nozzle spraying to a medium to be recorded is a second distance that is longer than a first distance, the adjustment section is preferably configured to adjust the suction amount of air sucked from the second suction port to be larger than that of when the spray distance is the first distance.

In the liquid ejection device according to an aspect of the present invention, the liquid preferably has light curing characteristics. The liquid ejection device preferably has an irradiation section configured and arranged to emit light for causing the liquid to cure and a cooling section to which heat generated by irradiation of light from the irradiation section is transferred, the cooling section being disposed between the first suction port and the discharge port.

In the liquid ejection device according to an aspect of the present invention, when a light irradiation intensity in the irradiation section is a second intensity that is stronger than a first intensity, the adjustment section is preferably configured to adjust the suction amount of air sucked from the second suction port to be larger than that of when the light irradiation intensity is the first intensity.

The liquid ejection device of the aspect of the present invention has an ejection head, and collects a mist of liquid generated by ejecting light curing liquid from the nozzle of the ejection head. The first suction port, the second suction port, and the discharge port are formed in the suction container. The second suction port is farther away from the nozzle compared to the first suction port. The cooling section is disposed in the suction container, and the cooling section is cooled by air sucked from the first suction port and the second suction port to the inside of the suction container. The suction device generates a suction force that sucks air to the inside of the suction container. The irradiation section emits light for causing liquid to cure. The irradiation section is disposed in a position where heat generated by light irradiation moves to the cooling section.

In the above-described configuration, the first suction port and the second suction port are formed in the suction container. When the suction amount of air in the second suction port is increased, the total amount of air that cools the cooling section can be increased without increasing the suction amount of air in the first suction port that is closer to the nozzle. In other words, the cooling effect on the irradiation section can be increased without increasing the suction amount of air in the first suction port by sucking air from the second suction port as well. Consequently, the cooling effect on the irradiation section can be increased while controlling the influence on the spray trajectory of the liquid ejected from the nozzle.

Further, the liquid ejection device may be provided with the adjustment section that adjusts the suction amount of air sucked from the second suction port to the inside of the suction container. The cooling capability with respect to the irradiation section can be adjusted by adjusting the suction amount of air in the second suction port. By adjusting the suction amount of air in the second suction port, the suction amount of air in the first suction port can be adjusted relatively while maintaining the cooling capability with respect to the irradiation section.

Here, as the spray distance from the nozzle to a medium to be recorded becomes longer, the spray trajectory of the liquid will easily be affected by air suction in the first suction port. Accordingly, in a case where the spray distance from the nozzle to a medium to be recorded is a second distance that is longer than a first distance, the adjustment section may make the suction amount of air sucked from the second suction port larger than that of a case where the spray distance is the first distance. Consequently, when the spray distance is long, the suction amount of air in the first suction port can be made relatively small and the spray trajectory of the liquid can be maintained to be normal.

In a case where the light irradiation intensity in the irradiation section is a second intensity that is stronger than a first intensity, the adjustment section may make the suction amount of air sucked from the second suction port larger than that of a case where the irradiation intensity is the first intensity. When the light irradiation intensity in the irradiation section is strong, the amount of heat generation in the irradiation section is large. Therefore, the total amount of air that cools the cooling section needs to be increased. In such a case, the cooling effect on the irradiation section can be increased by increasing the suction amount of air in the second suction port without increasing the suction amount of air in the first suction port. Consequently, the cooling effect on the irradiation section can be increased while controlling the influence on the spray trajectory of the liquid ejected from the nozzle.

Further, the adjustment section may adjust the suction amount of air sucked from the second suction port by changing an opening area of the second suction port. Consequently, with a simple configuration, the suction amount of air sucked from the second suction port can be adjusted.

Further, the air suction direction in the second suction port may be opposite to the air suction direction in the first suction port. The air suction direction in the first suction port is a direction that proceeds from a position closer to the nozzle toward a position farther from the nozzle, so that a mist generated from the nozzle can be sucked. Accordingly, when the air suction direction in the second suction port is made opposite to the air suction direction in the first suction port, the air suction direction in the second suction port is a direction that proceeds from a position farther from the nozzle toward a position closer to the nozzle. Air farther from the nozzle is more difficult to heat by reaction heat or the like due to light curing of the liquid ejected from the nozzle. Consequently, by making the air suction direction in the second suction port a direction that proceeds from a position farther from the nozzle toward a position closer to the nozzle, cold air can be sucked from the second suction port and the cooling effect on the irradiation section can be increased.

Further, the technique for collecting a mist according to the present invention can be implemented as a method. Also, the above-described device or method can be implemented as a single device, or can be implemented by being incorporated into a device having a complex function.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, embodiments of the present invention will be explained in the following order: (1) Configuration of Printer; and (2) Modified Embodiment.

(1) Configuration of Printer

Figure 1:
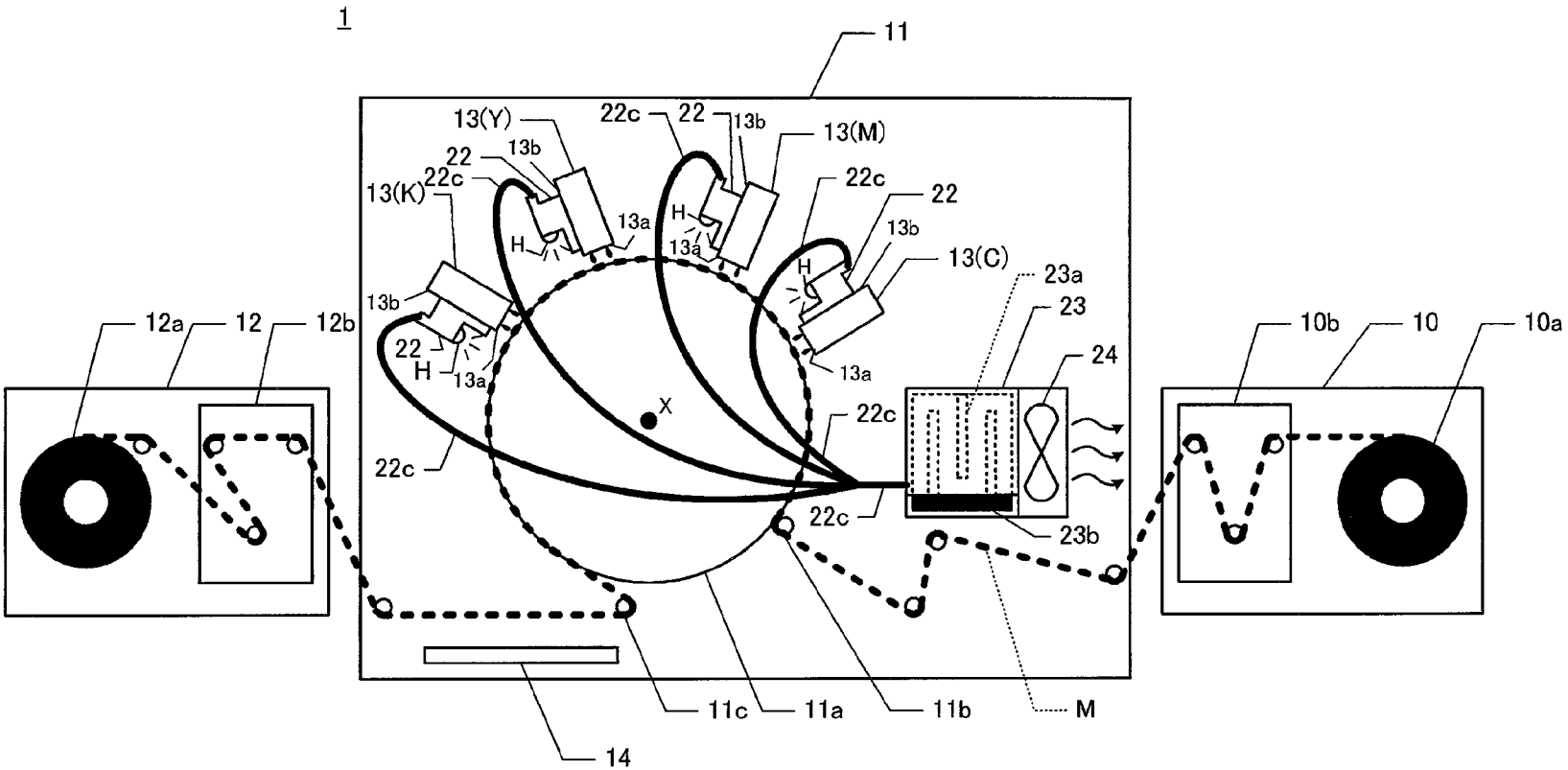
FIG. 1 is a block diagram of a printer.

FIG. 1 is a block diagram showing a configuration of a printer 1 as a liquid ejection device according to an embodiment of the present invention. The printer 1 has a feed section 10, a print section 11, a recovery section 12, an ejection head 13, and a control board 14. The feed section 10 has a feed reel 10*a* and a tension adjustment section 10*b*. A roll of paper M is rolled around a roll core of the feed reel 10*a*, and the roll of paper M is reeled out by rotating the feed reel 10*a* around a central axis of the roll core. The tension adjustment section 10*b* has a roller biased to exert prescribed tension on the roll of paper M between the feed reel 10*a* and the print section 11.

The print section 11 has a drum 11*a*, a feed-in roller 11*b*, and a feed-out roller 11*c*. The drum 11*a* is formed to have a cylindrical shape or an elliptic cylindrical shape, and rotates around a central axis X. The feed-in roller 11*b* is a roller for introducing a roll of paper M fed from the feed section 10 to the drum 11*a* in a tangential direction of the side surface of the drum 11*a*. The feed-out roller 11*c* is a roller for introducing out a roll of paper M retained on the side surface of the drum 11*a* in the tangential direction of the side surface of the drum 11*a*. When the drum 11*a* rotates counterclockwise with respect to the drawing, the roll of paper M can be retained on the side surface of the drum 11*a*, and the roll of paper M can be delivered from the feed section 10 to the recovery section 12.

The recovery section 12 has a recovery reel 12*a* and a tension adjustment section 12*b*. A roll of paper M is rolled around a roll core of the recovery reel 12*a*, and the roll of paper M is reeled in by rotating the recovery reel 12*a* around the central axis of the roll core. The tension adjustment section 12*b* has a roller biased to exert prescribed tension on the roll of paper M between the recovery reel 12*a* and the print section 11.

The ejection head 13 is provided for each kind of ink as the liquid. In the present embodiment, the ejection head 13 is provided for each of C (cyan), M (magenta), Y (yellow), and K (black). Each of the ejection heads 13 has a similar configuration, and is disposed to have rotation symmetry with respect to the central axis X of the drum 11*a*. Each of the ejection heads 13 has a nozzle surface 13*a* to face a roll of paper M retained on the side surface of the drum 11*a*. A plurality of nozzles are arranged in a surface of the nozzle surface 13*a*. Ink is ejected from the plurality of nozzles toward a roll of paper M retained on the side surface of the drum 11*a*. In each of the four ejection heads 13, a direction of ejecting ink is a direction toward the central axis X of the drum 11*a*.

The control board 14 is a board on which various kinds of circuits are mounted to control operations of the feed section 10, the print section 11, the recovery section 12, the ejection head 13, and the like.

Figure 2:
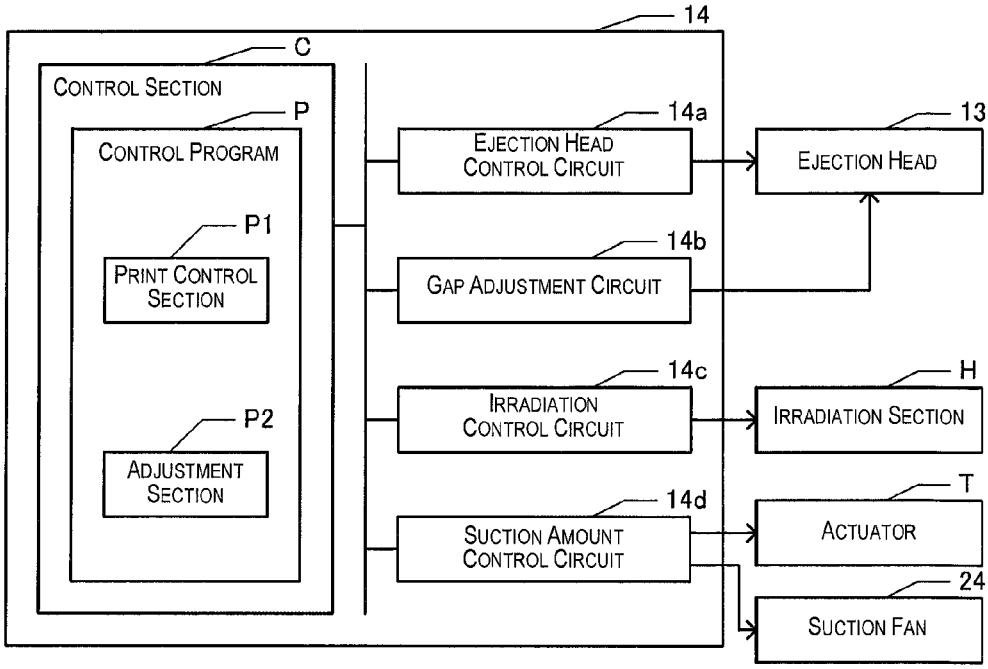
FIG. 2 is a block diagram of a control board.

FIG. 2 is a block diagram of the control board 14. The control board 14 includes a control section C, an ejection head control circuit 14*a*, a gap adjustment circuit 14*b*, an irradiation control circuit 14*c*, and a suction amount control circuit 14*d*. The control section C has hardware resources (CPU, RAM, ROM, and the like) to execute a control program P.

The ejection head control circuit 14*a* is a circuit for causing the ejection head 13 to eject ink drops. More specifically, the ejection head control circuit 14*a* includes a circuit that generates ejection data for designating whether or not a driving voltage is applied to a piezoelectric element provided for each nozzle of the ejection head 13, and a circuit that generates the driving voltage. When a driving voltage is applied to the piezoelectric element, the piezoelectric element deforms, and the pressure of ink in an ink chamber to which the nozzle connects changes. Then, in response to the change in the pressure of ink, the ink is ejected from the nozzle.

The gap adjustment circuit 14*b* is a circuit for adjusting the distance between the nozzle surface 13*a* of the ejection head 13 and a roll of paper M (paper gap PG). This paper gap PG corresponds to the spray distance of ink drops ejected from the nozzle on the nozzle surface 13*a* spraying until landing on the roll of paper M. The gap adjustment circuit 14*b* adjusts the paper gap PG by moving the ejection head 13 in a radial direction of the drum 11*a* in response to, for example, user settings, the kind of the roll of paper M, and measurement results of the paper gap PG.

The irradiation control circuit 14*c* is a circuit for causing an irradiation section H to emit ultraviolet light. In the present embodiment, the irradiation section H is an LED (Light Emitting Diode) mounted on an irradiation board. The irradiation control circuit 14*c* generates a current for driving the LED. The irradiation control circuit 14*c* increases the irradiation intensity I of ultraviolet light in the irradiation section H as the number of ink drops ejected from the ejection head 13 becomes large, that is, a print image formed on the roll of paper M by subtractive color mixing becomes dark.

The suction amount control circuit 14*d* is a circuit for adjusting the suction amount of air sucked into a suction container 22 (FIG. 1). More specifically, the suction amount control circuit 14*d* generates a driving signal for driving an actuator T provided in the suction container 22. As shown in FIG. 1, the printer 1 has the suction container 22, a collection container 23, and a suction fan 24 as a configuration for collecting a mist of ink. The suction container 22 is provided corresponding to each of the ejection heads 13, and is disposed adjacent to each of the ejection heads 13. The suction container 22 is disposed adjacent to a vertical wall surface 13*b* (wall surface perpendicular to the nozzle surface 13*a*) of each of the ejection heads 13 from the clockwise direction with respect to the drawing.

Air inside the collection container 23 is sucked by driving the suction fan 24 as the suction device. Each of the plurality of the suction containers 22 has a discharge port O, and an outlet section 22*c* connects to the discharge port O. Each of the plurality of the suction containers 22 is connected to the single collection container 23 through the outlet section 22*c*, and air inside each of the suction containers 22 is collected into the collection container 23. A collection wall 23*a* (broken like) is formed inside the collection container 23. When a mist of ink contained in air in the collection container 23 collides with the collection wall 23*a*, the mist of ink is turned into liquid drops. A reservoir section 23*b* is provided at a lower part of the collection container 23 in the vertical direction. Ink that has been turned into liquid drops flows down to the reservoir section 23*b*, and is stored in the reservoir section 23*b*. For example, the reservoir section 23*b* may be removable from the main body of the collection container 23, and the reservoir section 23*b* can be replaced or cleaned by removing the reservoir section 23*b* from the collection container 23.

Figure 3A:
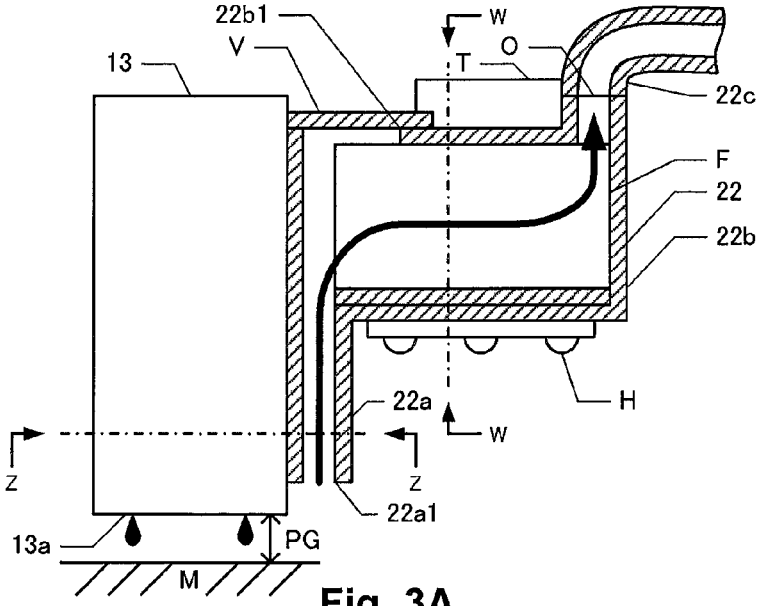
FIG. 3A and 3B are cross-sectional views of a suction container.
Figure 3B:
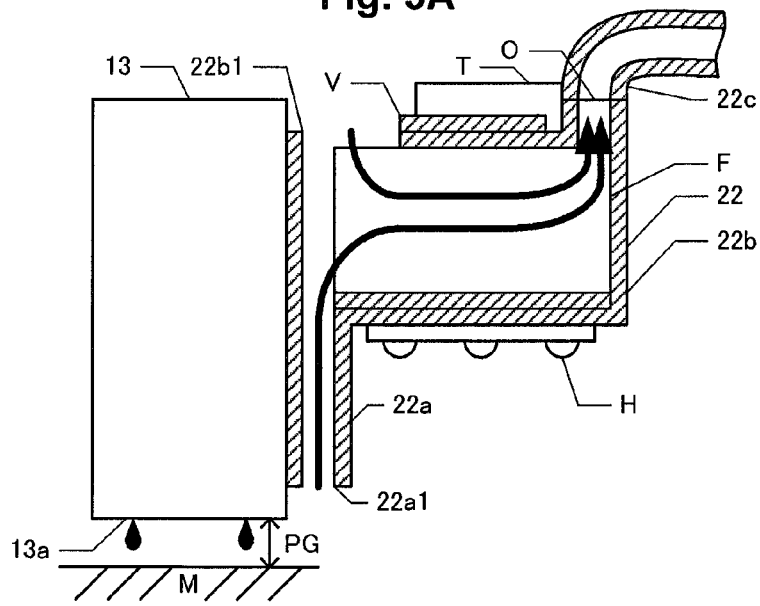

FIG. 3A and 3B are cross-sectional views of the suction container 22 cut in a direction perpendicular to the central axis X of the drum 11*a*. The suction container 22 has a suction section 22*a*, a main body section 22*b*, and the outlet section 22*c*. A first suction port 22*a*1 is formed at a lower end of the suction section 22*a*. The suction section 22*a* and the main body section 22*b* are connected to each other at an upper end of the suction section 22*a*. The suction section 22*a* is adjacent to the vertical wall surface 13*b* of the ejection head 13, and the first suction port 22*a*1 is formed within a prescribed distance from the nozzle surface 13*a* of the ejection head 13. Specifically, the distance between the first suction port 22*a*1 and the nozzle surface 13*a* is a distance that allows a mist of ink generated when ink drops are ejected from the nozzle on the nozzle surface 13*a* to be sucked.

Figure 3C:
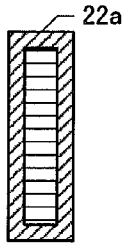
FIG. 3C is a cross-sectional view of a suction section.

FIG. 3C is a Z-Z line cross-sectional view of the suction section 22*a*. The Z-Z line cross-section is a cross-section parallel to the nozzle surface 13*a*. The cross-section of the suction section 22*a* parallel to the nozzle surface 13*a* has a rectangular shape, and an air passage (transverse hatching) having a rectangular shape is formed inside. The suction section 22*a* has a uniform shape with respect to the height direction along the vertical wall surface 13*b*, and the shape of the air passage of the suction section 22*a* is uniform from the upper end to the first suction port 22*a*1 at the lower end.

Figure 3D:
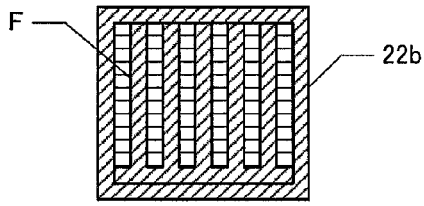
FIG. 3D is a cross-sectional view of a main body section.

FIG. 3D is a W-W line cross-sectional view of the main body section 22*b*. The W-W line cross-section is a cross-section parallel to the vertical wall surface 13*b*. The main body section 22*b* accommodates a heat sink F as the cooling section in the inside thereof. The heat sink F has a flat-shaped bottom section that adheres to the bottom surface of the main body section 22*b*, and a plurality of flat-shaped wing sections that project vertically upward with respect to the bottom section. The heat sink F is made of metal or the like having good heat conductivity, and heat of the bottom section moves to the plurality of wing sections. The plurality of wing sections are in parallel with respect to each other, and gaps (transverse hatching) between the wing sections are formed in the vertical direction with respect to the vertical wall surface 13*b*. These gaps serve as air passages in the main body section 22*b*. The cross-sectional area of the air passage in the suction section 22*a* (the opening area of the first suction port 22*a*1) is smaller than the sum of the cross-sectional areas of the gaps between the wings sections in the main body section 22*b*.

The suction container 22 is made of metal or the like having good heat conductivity, and the irradiation board is disposed in a position that faces the bottom section of the heat sink F in a state of sandwiching the bottom surface of the main body section 22*b* therebetween. Accordingly, heat generated when the irradiation section H on the irradiation board emits ultraviolet light is allowed to move to the heat sink F through the bottom surface of the main body section 22*b*.

A second suction port 22*b*1 that opens upward is formed in the upper surface of the main body section 22*b*. The first suction port 22*a*1 is closer to the nozzle surface 13*a* compared to the second suction port 22*b*1. A flat-shaped shutter V is provided on the upper surface of the main body section 22*b*. The shutter V slides on the upper surface of the main body section 22*b* by driving the actuator T. The shutter V is formed to be larger than the second suction port 22*b*1 in a direction parallel to the upper surface of the main body section 22*b*. When the shutter V moves toward the ejection head 13 as shown in FIG. 3A, the second suction port 22*b*1 is closed. When the shutter V moves away from the ejection head 13 as shown in FIG. 3B, the second suction port 22*b*1 is opened. Accordingly, an effective opening area S of the second suction port 22*b*1 becomes large as the shutter V gets away from the ejection head 13.

The main body section 22*b* and the outlet section 22*c* are connected in an end portion on the upper surface of the main body section 22*b* opposite to the ejection head 13. As described above, the outlet section 22*c* connects to the collection container 23, and air inside the collection container 23 is sucked by driving the suction fan 24. Consequently, air inside the suction container 22 is sucked to the outside through the outlet section 22*c* by driving the suction fan 24, and air pressure inside the suction container 22 decreases. Then, air is sucked into the suction container 22 from the outside. When the shutter V moves to open the second suction port 22*b*1 as shown in FIG. 3B, the suction container 22 connects to the outside through the first suction port 22*a*1 and the second suction port 22*b*1, and air is sucked to the inside through the first suction port 22*a*1 and the second suction port 22*b*1. On the other hand, when the shutter V moves to close the second suction port 22*b*1 as shown in FIG. 3A, the suction container 22 connects to the outside through the first suction port 22*a*1, and air is sucked to the inside through the first suction port 22*a*1. In FIG. 3A and FIG. 3B, the air suction direction is shown by a thick arrow.

The air suction direction in the suction section 22*a* is a direction that proceeds from below to above along the vertical wall surface 13*b*. Specifically, the air suction direction in the first suction port 22*a*1 of the suction section 22*a* is a direction that proceeds from a position closer to the nozzle surface 13*a* toward a position farther from the nozzle surface 13*a*. Therefore, air containing a mist of ink generated from the nozzle surface 13*a* can be sucked into the inside of the suction container 22 through the first suction port 22*a*1. On the other hand, the air suction direction in the second suction port 22*b*1 in a state of being opened is a direction that proceeds from above to below. Specifically, the air suction direction in the second suction port 22*b*1 is a direction that proceeds from a position farther from the nozzle surface 13*a* toward a position closer to the nozzle surface 13*a*. Therefore, air of lower temperature compared to air near the nozzle surface 13*a* can be sucked into the inside of the suction container 22 through the second suction port 22*b*1. Air near the nozzle surface 13*a* has high temperature due to reaction heat when ink cures by ultraviolet light, heat of the piezoelectric element existing in the vicinity of the nozzle surface 13*a*, or the like. Air sucked to the inside of the suction container 22 through the first suction port 22*a*1 and the second suction port 22*b*1 passes through the gaps between the wing sections of the heat sink F in the main body section 22*b*, and reaches the outlet section 22*c*. Accordingly, the heat sink F can be cooled by air passing through the gaps between the wing sections. Since heat of the irradiation section H moves to the heat sink F, the irradiation section H can be cooled. Next, the configuration of the control program P executed by the control section C will be explained.

The control program P includes a print control section P1 and an adjustment section P2. The control section C conducts various kinds of processing (color conversion, halftone, and the like) to image data to be printed and outputs it to the ejection head control circuit 14*a* through the function of the print control section P1. In response to this, the ejection head control circuit 14*a* generates ejection data that can be output to the ejection head 13. The control section C also conducts processing to control a delivery system for a roll of paper M such as the feed section 10, the recovery section 12, and the like through the function of the print control section P1. Further, the control section C specifies the concentration (total number of ejected ink drops) of a print image based on image data to be printed and orders the irradiation control circuit 14*c* to make the irradiation intensity I of the irradiation section H larger as the concentration becomes higher through the function of the print control section P1. Also, the control section C orders the gap adjustment circuit 14*b* to move the ejection head 13 to a position corresponding to the paper gap PG designated by a user or the like through the function of the print control section P1.

The adjustment section P2 is a module that causes the control section C to implement the function of adjusting the air suction amount in the second suction port 22*b*1. Specifically, the control section C specifies the effective opening area S of the second suction port 22*b* 1 through the function of the adjustment section P2, and orders the suction amount control circuit 14*d* to move the shutter V to a position to open the second suction port 22*b*1 by this effective opening area S. In the present embodiment, the suction force generated by the suction fan 24 is uniform, and the air suction amount in the second suction port 22*b* 1 becomes large as the effective opening area S of the second suction port 22*b*1 increases.

Figure 4A:
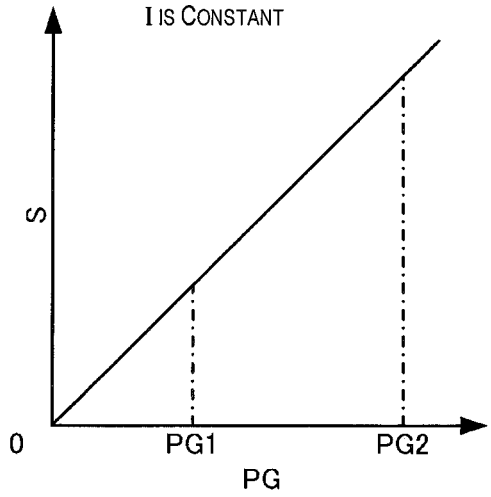
FIG. 4A and 4B are graphs showing an effective opening area.

FIG. 4A is a graph showing a relationship between the paper gap PG and the effective opening area S of the second suction port 22*b*1. In FIG. 4A, the light irradiation intensity I of the irradiation section H is constant. As shown in FIG. 4A, through the function of the adjustment section P2, the control section C makes the effective opening area S of the second suction port 22*b*1 larger as the paper gap PG becomes larger. Accordingly, in a case where the paper gap PG is a second distance PG2 that is longer than a first distance PG1, the effective opening area S of the second suction port 22*b*1 becomes larger than that of a case where the paper gap PG is the first distance PG1.

Figure 4B:
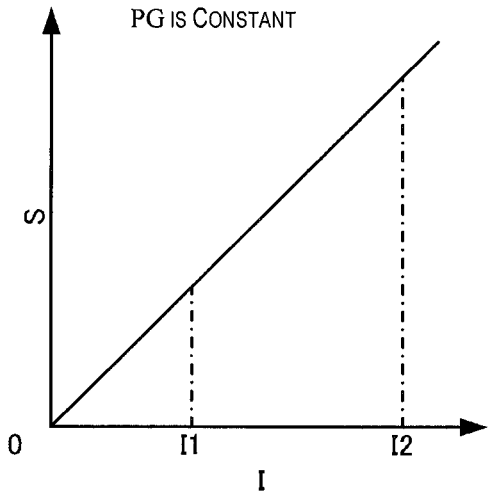

FIG. 4B is a graph showing a relationship between the light irradiation intensity I of the irradiation section H and the effective opening area S of the second suction port 22*b*1. In FIG. 4B, the paper gap PG is constant. As shown in FIG. 4B, through the function of the adjustment section P2, the control section C makes the effective opening area S of the second suction port 22*b*1 larger as the irradiation intensity I becomes larger. Accordingly, in a case where the light irradiation intensity I of the irradiation section H is a second intensity 12 that is stronger than a first intensity I1, the effective opening area S of the second suction port 22*b*1 becomes larger than that of a case where the irradiation intensity I is the first intensity I1.

In the above-described configuration, when the air suction amount in the second suction port 22*b* 1 is made large, the total amount of air for cooling the heat sink F can be made large without increasing the air suction amount in the first suction port 22*a*1 close to the nozzle surface 13*a*. Specifically, by making the air suction amount in the second suction port 22*b*1 large, the cooling effect on the irradiation section H can be increased while controlling the influence on the spray trajectories of the liquid drops ejected from the nozzle.

Also, in a case where the paper gap PG from the nozzle to the roll of paper M is the second distance PG2 that is longer than the first distance PG1, the control section C makes the air suction amount in the second suction port 22*b*1 larger than that of a case where the paper gap PG is the first distance PG1 through the function of the adjustment section P2. Consequently, it is possible to prevent air suction in the first suction port 22*a*1 from affecting the spray trajectory of ink even when the spray distance of ink drops becomes long.

Also, in a case where the light irradiation intensity I of the irradiation section H is the second intensity 12 that is stronger than the first intensity I1, the control section C makes the suction amount of air sucked from the second suction port 22*b* 1 larger than that of a case where the irradiation intensity I is the first intensity I1 through the function of the adjustment section P2. When the light irradiation intensity I of the irradiation section H is strong, the amount of heat generated in the irradiation section H is large. However, by making the air suction amount in the second suction port 22*b* 1 large, the cooling effect on the irradiation section H can be increased while controlling the influence on the spray trajectory of ink ejected from the nozzle.

Further, the control section C adjusts the suction amount of air sucked from the second suction port 22*b*1 by changing the effective opening area S of the second suction port 22*b*1 through the function of the adjustment section P2. Consequently, with a simple configuration, the suction amount of air sucked from the second suction port 22*b*1 can be adjusted. Also, the air suction direction in the second suction port 22*b* 1 is a direction that proceeds from a position farther from the nozzle toward a position closer to the nozzle. Since air farther from the nozzle is more difficult to heat by reaction heat and the like due to light curing of ink ejected from the nozzle, cold air can be sucked from the second suction port 22*b*1 and the cooling effect on the irradiation section H can be increased.

(2) Modified Embodiment

In the above-described embodiment, the air suction amount in the second suction port 22*b*1 is adjusted. However, the air suction amount in the second suction port 22*b*1 may be uniform. That is, the shutter V does not always need to be provided. Even in a case where the effective opening area S of the second suction port 22*b*1 is uniform, the total amount of air sucked into the suction container 22 can be increased without increasing the air suction amount in the first suction port 22*a*1. The air suction amount in the second suction port 22*b*1 may be adjusted based on the light irradiation intensity I of the irradiation section H only, or may be adjusted based on the paper gap PG only.

In the above-described embodiment, the printer 1 ejects ink. However, light curing liquid is sufficient, and liquid other than ink may be ejected. Further, liquid may be ejected by applying pressure due to a mechanical change of the piezoelectric element, or may be ejected by applying pressure due to generation of air bubbles. Further, a medium to be recorded is not limited to printing paper, and may be cloth or a film made of resin, or the like. A medium to be recorded is not limited to one that is retained on the side surface of the drum, and may be retained on a platen having a flat shape. Further, the ejection heads do not need to be plural, and a single or a plurality of suction containers may be provided with respect to a single ejection head.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

an ejection head configured and arranged to eject liquid from a nozzle;

a suction container in which a first suction port, a second suction port that is farther away from the nozzle compared to the first suction port, and a discharge port are formed, air sucked from the first suction port and the second suction port passing through the suction container; and a suction device configured and arranged to suck the air from the discharge port to an outside of the suction container.

2. The liquid ejection device according to claim 1, further comprising an adjustment section configured and arranged to adjust a suction amount of air in the second suction port.

3. The liquid ejection device according to claim 2, wherein the adjustment section is configured and arranged to adjust the suction amount of air sucked from the second suction port by changing an opening area of the second suction port.

4. The liquid ejection device according to clam 2, wherein, when a spray distance of the liquid ejected from the nozzle spraying to a medium to be recorded is a second distance that is longer than a first distance, the adjustment section is configured to adjust the suction amount of air sucked from the second suction port to be larger than that of when the spray distance is the first distance.

5. The liquid ejection device according to claim 2, wherein the liquid has light curing characteristics, and the liquid ejection device has an irradiation section configured and arranged to emit light for causing the liquid to cure and a cooling section to which heat generated by irradiation of light from the irradiation section is transferred, the cooling section being disposed between the first suction port and the discharge port.

6. The liquid ejection device according to claim 5, wherein when a light irradiation intensity in the irradiation section is a second intensity that is stronger than a first intensity, the adjustment section is configured to adjust the suction amount of air sucked from the second suction port to be larger than that of when the light irradiation intensity is the first intensity.

7. The liquid ejection device according to claim 1, wherein an air suction direction in the second suction port is opposite to an air suction direction in the first suction port.

* * * * *